US009685685B2

(12) United States Patent
Chun

(10) Patent No.: US 9,685,685 B2
(45) Date of Patent: Jun. 20, 2017

(54) VARIABLE BANDWIDTH RF FILTER

(71) Applicant: ACE TECHNOLOGIES CORPORATION, Incheon (KR)

(72) Inventor: Dong-Wan Chun, Incheon (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 73 days.

(21) Appl. No.: 14/389,710

(22) PCT Filed: Mar. 28, 2013

(86) PCT No.: PCT/KR2013/002579
§ 371 (c)(1),
(2) Date: Sep. 30, 2014

(87) PCT Pub. No.: WO2013/147524
PCT Pub. Date: Oct. 3, 2013

(65) Prior Publication Data

US 2015/0061792 A1 Mar. 5, 2015

(30) Foreign Application Priority Data

Mar. 30, 2012 (KR) ..... 10-2012-0032827

(51) Int. Cl.
*H01P 1/205* (2006.01)
*H01P 7/04* (2006.01)
*H01P 1/208* (2006.01)

(52) U.S. Cl.
CPC ..... *H01P 1/2053* (2013.01); *H01P 1/208* (2013.01); *H01P 7/04* (2013.01); *H01P 1/2084* (2013.01)

(58) Field of Classification Search
CPC ..... H01P 1/208; H01P 1/2084; H01P 1/205; H01P 1/2053; H01P 7/04
USPC ..... 333/202, 203, 206, 207, 219, 222
See application file for complete search history.

(56) References Cited

U.S. PATENT DOCUMENTS 4,477,785 A * 10/1984 Atia ..... H01P 1/2084 333/202
5,023,579 A * 6/1991 Bentivenga ..... H01P 1/205 333/203
5,543,758 A * 8/1996 Wey ..... H01P 1/205 333/202
6,664,872 B2 * 12/2003 Channabasappa ..... H01P 1/205 333/202

(Continued)

FOREIGN PATENT DOCUMENTS

JP 2000-295041 A 10/2000
KR 20-1999-0014411 U 5/1999

OTHER PUBLICATIONS

International Search Report for PCT/KR2013/002579 filed on Mar. 28, 2013.

*Primary Examiner* — Benny Lee
*Assistant Examiner* — Jorge Salazar, Jr.

(57) ABSTRACT

Disclosed is a variable bandwidth RF filter. The disclosed filter comprises: a first filter unit having a first bandwidth and a variable-frequency structure; and a second filter unit having a second bandwidth and a variable-frequency structure. The first filter unit and the second filter unit are coupled to a cascade structure, and the bandwidth is adjusted by varying the frequency of the first filter unit and of the second filter unit. The disclosed filter is advantageous in that the variation of the bandwidth can be easily performed using a simple structure.

7 Claims, 8 Drawing Sheets

(56) References Cited

U.S. PATENT DOCUMENTS

| | | | | |
|---|---|---|---|---|
| 2002/0044021 | A1 | 4/2002 | Van Der Woude et al. | |
| 2005/0136876 | A1* | 6/2005 | Broholm | H01P 1/2053 455/307 |
| 2005/0212623 | A1* | 9/2005 | Ala-Kojola | H01P 1/2053 333/202 |
| 2006/0154628 | A1 | 7/2006 | Mochizuki | |
| 2009/0058563 | A1* | 3/2009 | Seo | H01P 7/04 333/209 |
| 2010/0244945 | A1 | 9/2010 | Hahn et al. | |

* cited by examiner (a)Frequency tunable BPF1 response (b)Frequency tunable BPF2 response (c)Cascaded filter response (a)Frequency tunable BPF1 response with notch filter (b)Frequency tunable BPF1 response with notch filter (c)Cascaded filter response with notch filter

VARIABLE BANDWIDTH RF FILTER

CROSS-REFERENCE TO RELATED APPLICATIONS

This application is a National Phase Application of PCT International Application No. PCT/KR2013/002579, which was filed on Mar. 28, 2013, and which claims priority from Korean Patent Application No. 10-2012-0032827, filed with the Korean Intellectual Property Office on Mar. 30, 2012. The disclosures of the above patent applications are incorporated herein by reference in their entirety.

BACKGROUND

1. Technical Field

Embodiments of the present invention relate to an RF filter, more particularly to an RF filter with which it is possible to alter the bandwidth.

2. Description of the Related Art

Communication systems in recent times are evolving from 3G to 4G systems. Existing communication systems and advanced communication systems currently coexist. Under such circumstances, there have been researches focused on ways to utilize existing base station equipment, and one outcome of such researches is the technology of tunable filters.

With the advances in communication technology, the bandwidths of systems that employ existing communication systems are gradually decreasing, while the bandwidths of systems that employ newer communication systems are gradually increasing.

If an RF filter capable of altering its bandwidth and center frequency were developed, then it would be possible to remotely change the filter's bandwidth and center frequency according to advances in communication technology without replacing existing equipment.

Thus, there is a demand for a filter having a tunable, but existing studies have mainly focused on frequency-tunable filters and there have been relatively less research on filters capable of altering its bandwidth.

SUMMARY

An aspect of the invention is to provide a bandwidth tunable filter with which changes in the frequency bandwidth can be easily achieved.

To achieve the objective above, an embodiment of the present invention provides a bandwidth tunable filter that includes: a first filter unit having a first band and having a structure capable of frequency alteration; and a second filter unit having a second band and having a structure capable of frequency alteration, where the first filter unit and the second filter unit are joined in a cascaded structure.

The first filter unit and the second filter unit may include at least one cavity and a resonator held in each cavity.

The first filter unit and the second filter unit may respectively include a first sliding member and a second sliding member for altering frequency, and alterations of frequency of the first filter unit and the second filter unit may be performed independently.

The first filter unit and the second filter unit may be included in the same housing, and an output signal of the first filter unit may be provided as an input to the second filter unit.

An input connector may be joined to the cavity that holds the first resonator of the first filter unit, and an output connector may be joined to the cavity that holds the last resonator of the second filter unit.

The last resonator of the first filter unit and the last resonator of the second filter unit may be connected by way of a transition line.

A coupling window for a coupling of signals may be formed between the cavity holding the last resonator of the first filter unit and the cavity holding the first resonator of the second filter unit.

A first notch cavity for forming a transmission zero may be additionally formed next to at least one cavity from among the cavities of the first filter unit.

A second notch cavity for forming a transmission zero may be additionally formed next to at least one cavity from among the cavities of the second filter unit.

Another aspect of the invention provides a bandwidth tunable filter that includes: a housing; a first filter unit, which is equipped within the housing, has a first band, and has a structure capable of frequency alteration; and a second filter unit, which is equipped within the housing, has a second band, and has a structure capable of frequency alteration, where an output signal of the first filter unit is provided as an input to the second filter unit.

A filter based on an embodiment of the invention uses a simple structure to allow easy alteration of the bandwidth.

Additional aspects and advantages of the present invention will be set forth in part in the description which follows, and in part will be obvious from the description, or may be learned by practice of the invention.

DETAILED DESCRIPTION

Figure 1:
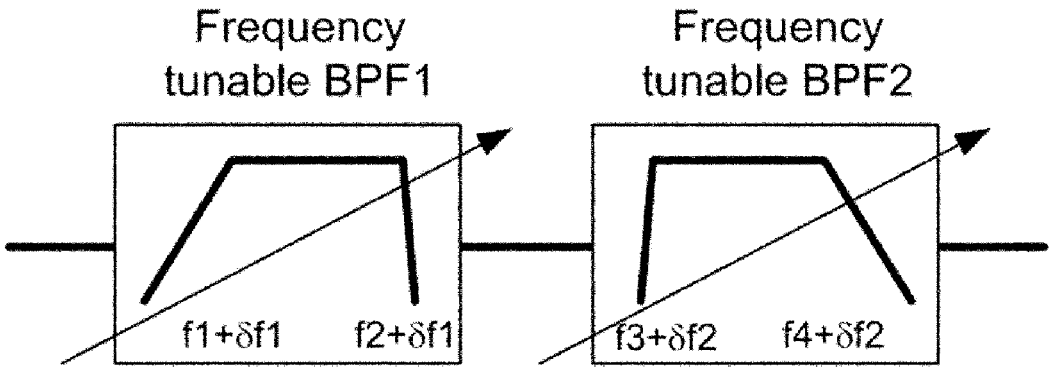
FIG. 1 is a diagram conceptually illustrating the structure of a bandwidth tunable filter according to an embodiment of the invention.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, like reference numerals are used for like elements.

Certain embodiments of the invention are described below in more detail with reference to the accompanying drawings.

FIG. 1 is a diagram conceptually illustrating the structure of a bandwidth tunable filter according to an embodiment of the invention.

Referring to FIG. 1, a bandwidth tunable filter according to an embodiment of the invention may include two frequency tunable filters that are connected in a cascaded manner.

Here, a frequency tunable filter refers to a filter in which the resonance frequency of the filter can be changed by way of a structural alteration of the filter.

One example may include, for instance, a frequency tunable filter that can alter the resonance frequency of the filter by a sliding movement of a sliding member. Besides the sliding-based frequency tunable filter, a filter that alters its frequency by rotating a dielectric body within the filter can be used, and various other types of frequency tunable filters can be used as well.

An aspect of the present invention proposes a bandwidth tunable filter that connects two or more of such frequency tunable filters in a cascaded manner to alter the bandwidth by varying the center frequency of each frequency tunable filter.

By altering the resonance frequencies of two frequency tunable filters, it is possible to substantially change the bandwidth.

Figure 2:
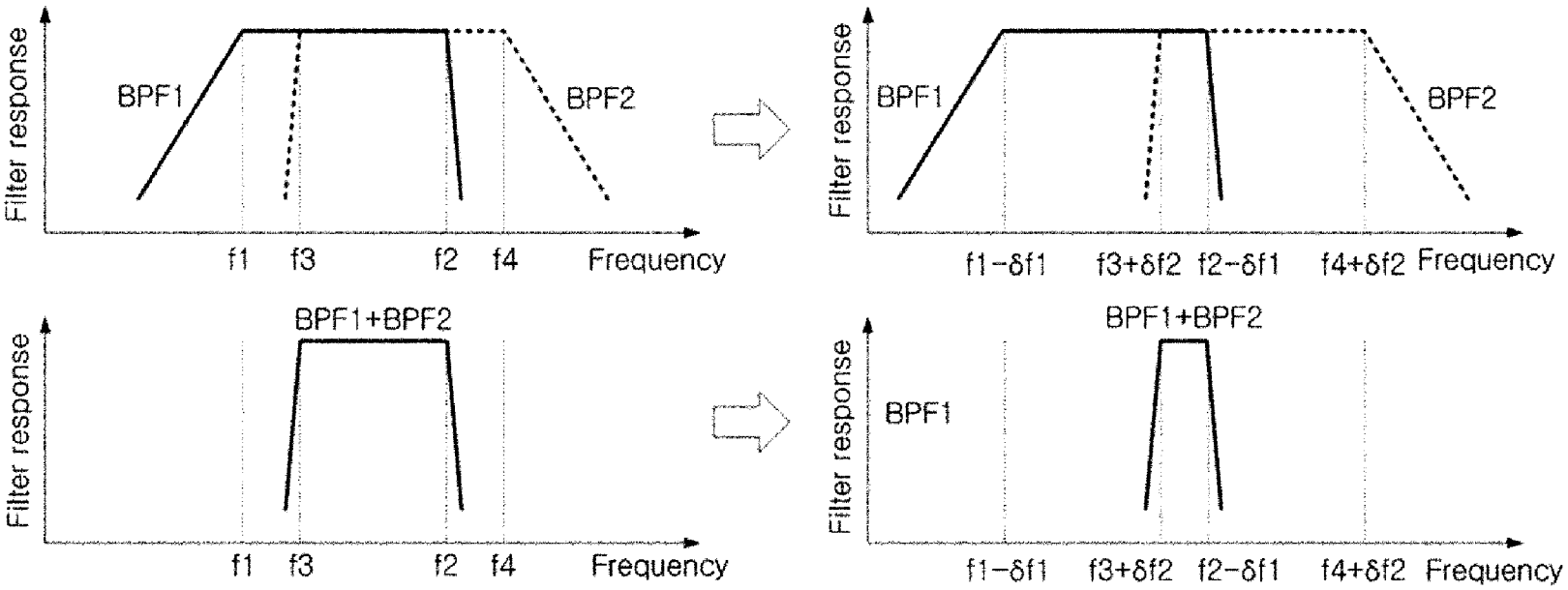
FIG. 2 is a diagram illustrating the process by which the bandwidth is altered in accordance to a change in the resonance frequency of each of the frequency tunable filters connected in a cascaded manner.

FIG. 2 is a diagram illustrating the process by which the bandwidth is altered in accordance to a change in the resonance frequency of each of the frequency tunable filters connected in a cascaded manner.

In FIG. 2, the graphs on the top show the band of a first frequency tunable filter, BPF1, and the band of a second frequency tunable filter, BPF2, while the graphs on the bottom show only the bandwidths that are substantially formed by the two filters (BPF1 and BPF2).

Referring to the upper left graph of FIG. 2, it can be seen that the first frequency tunable filter BPF1 and the second frequency tunable filter BPF2 resonate in different bands and that there is a resonance band that is common to the two.

Referring to the lower left graph of FIG. 2, it can be seen that the passband of the bandwidth tunable filter, in which BPF1 and BPF2 are connected in a cascaded manner according to an embodiment of the invention, is the resonance band common to the first frequency tunable filter BPF1 and the second frequency tunable filter BPF2 (i.e. the intersection of the resonance band of the first frequency tunable filter and the resonance band of the second frequency tunable filter).

With the bandwidth tunable filter based on an embodiment of the invention, it is possible to alter the bandwidth by altering the center frequencies of the first frequency tunable filter BPF1 and second frequency tunable filter BPF2. In FIG. 2, the upper right graph shows the case after moving the center frequency of the first frequency tunable filter BPF1 by −f1 and moving the center frequency of the second frequency tunable filter BPF2 by +f2, while the lower right graph shows how the resonance band has changed due to the movement of frequencies.

Referring to FIG. 2, it can be seen that the common resonance band of the first frequency tunable filter BPF1 and second frequency tunable filter BPF2 becomes narrower due to the movement of center frequencies described above, and hence that the bandwidth of the filter in which BPF1+BPF2 are cascaded becomes narrower.

In other words, it is possible to achieve a substantial change in bandwidth by moving the center frequencies of the first frequency tunable filter BPF1 and second frequency tunable filter BPF2.

Although FIG. 2 illustrates the case of altering the center frequencies of the first frequency tunable filter BPF1 and second frequency tunable filter BPF2 such that the bandwidth becomes narrower, it should be apparent to those skilled in the art that the same principle can be used to alter the bandwidth such that the bandwidth is expanded.

Also, it should be apparent to those skilled in the art that, by changing the amount of frequency alteration of the first frequency tunable filter BPF1 and the amount of frequency alteration of the second frequency tunable filter BPF2, it is possible to change the bandwidth as well as the center frequency.

Figure 3:
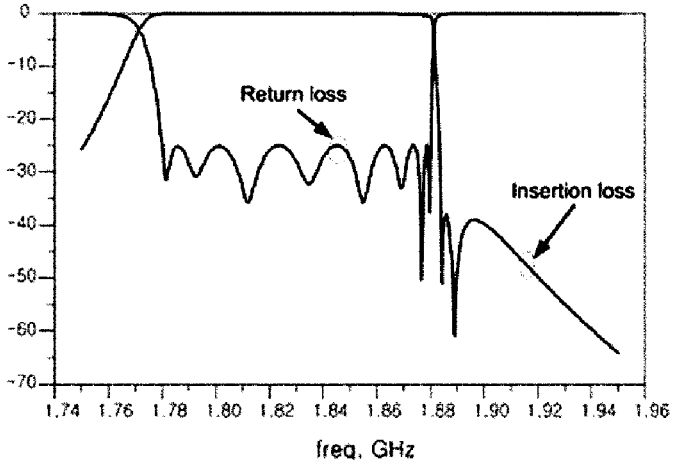
FIG. 3 shows graphs (a) and (b) representing the frequency response properties of a first frequency tunable filter, BPF1, and a second frequency tunable filter, BPF2, and a graph (c) representing the frequency response of a filter in which BPF1 and BPF2 are cascaded according to the spirit of the present invention.
Figure 3:
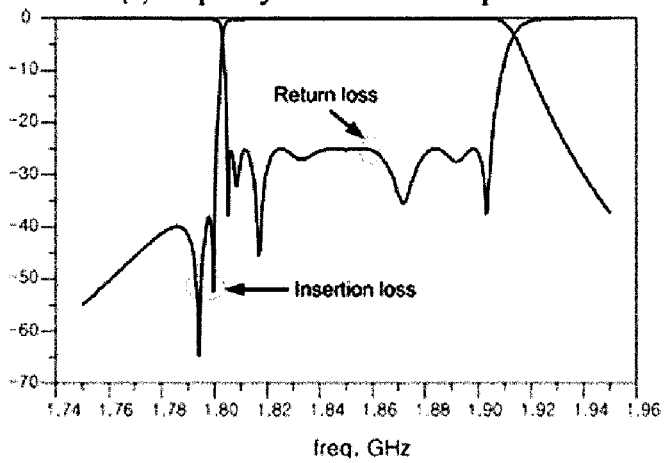
Figure 3:
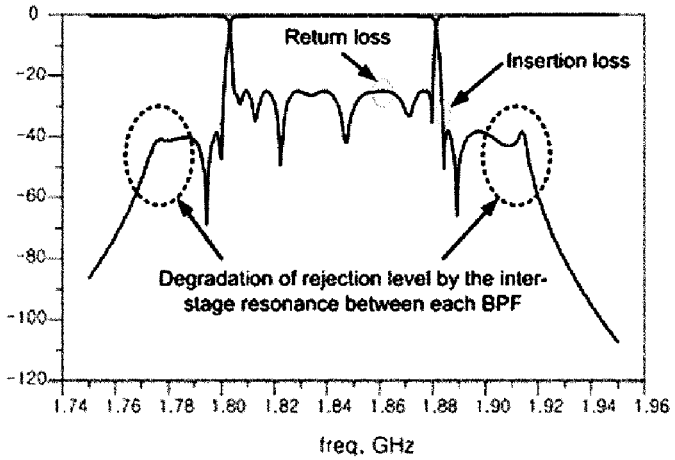

FIG. 3 shows graphs (a) and (b) representing the frequency response properties of a first frequency tunable filter, BPF1, and a second frequency tunable filter, BPF2, and a graph (c) representing the frequency response of a filter in which BPF1 and BPF2 are cascaded according to the spirit of the present invention.

To allow bandwidth tuning in the passband, BPF1 was implemented with a broader lower band (1780-1880 MHz) and BPF2 was implemented with a broader upper band (1805-1905 MHz) than the desired band (1805-1880 MHz). Referring to graph (c) of FIG. 3, it can be seen that inter-stage resonance occurs between BPF1 and BPF2, so that the attenuation properties are degraded at the stopbands on both sides.

Figure 4:
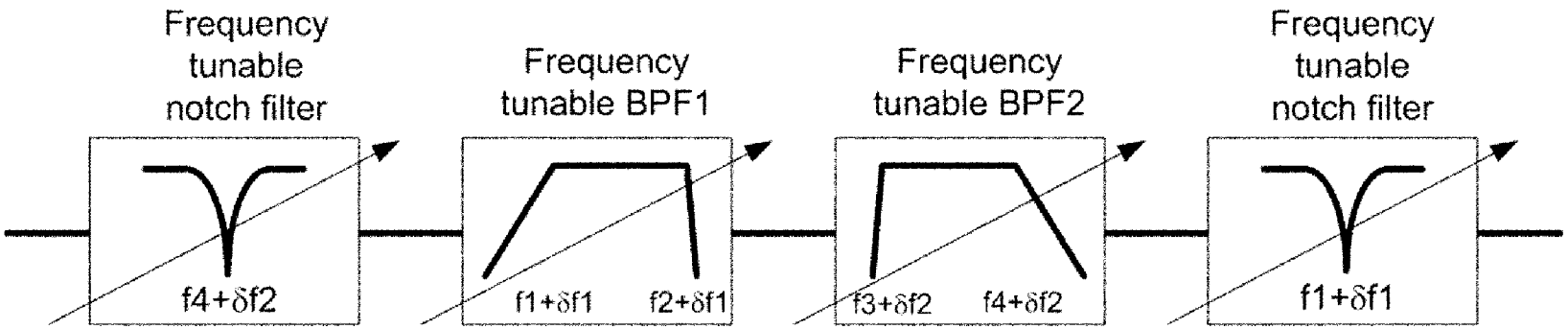
FIG. 4 is a block diagram of a bandwidth tunable filter prepared against an occurrence of inter-stage resonance according to another embodiment of the invention.

FIG. 4 is a block diagram of a bandwidth tunable filter that has been prepared against an occurrence of inter-stage resonance according to another embodiment of the invention.

Referring to FIG. 4, a bandwidth tunable filter according to an embodiment of the invention may include a first notch filter 400, a first frequency tunable filter BPF1, a second frequency tunable filter BPF2, and a second notch filter 410.

Referring to FIG. 4, a notch filter 400, 410 capable of frequency tuning may be added to each of the first frequency tunable filter BPF1 and the second frequency tunable filter BPF2. The notch filter can be implemented as a structure of cavities and resonators or can be implemented in an air strip line stub form.

When the notch filters are included in the same housing, the notch filters can be implemented in the form of notch cavities, as can be seen below with reference to FIG. 6.

Figure 5:
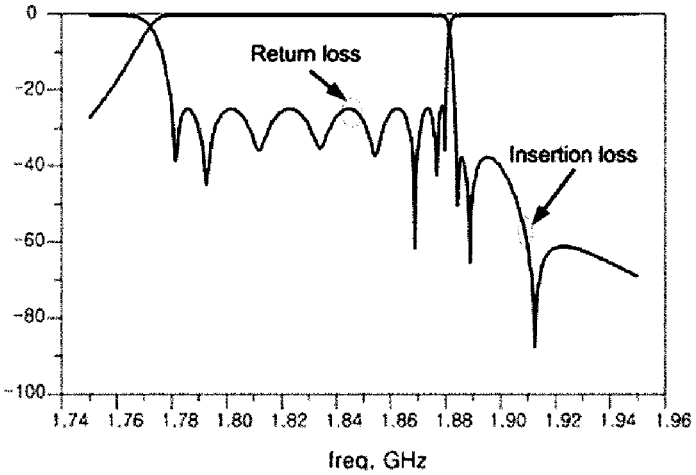
FIG. 5 shows graphs (a), (b) representing the transfer properties of BPF1 and BPF2 to which notch cavities have been applied on the input and output ends and a graph (c) representing the transfer properties of the cascaded filter.
Figure 5:
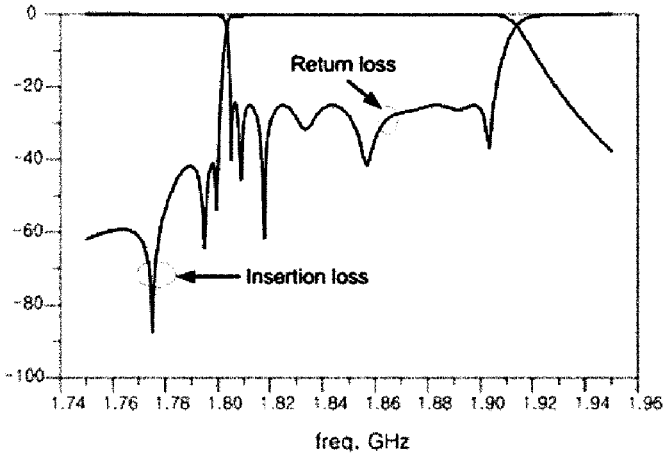
Figure 5:
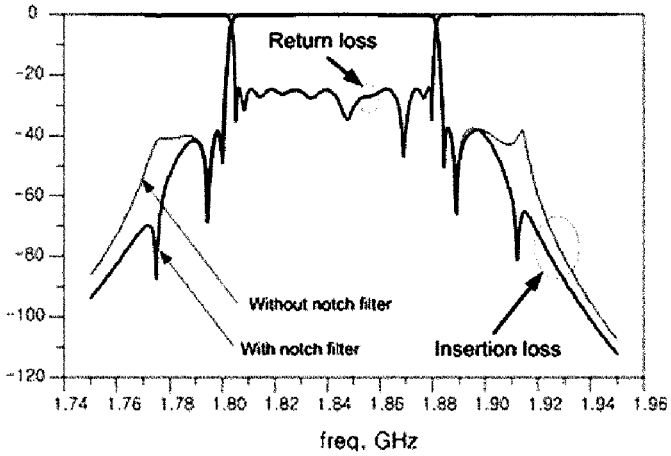

FIG. 5 shows graphs (a), (b) representing the transfer properties of BPF1 and BPF2 to which notch cavities have been applied on the input and output ends and a graph (c) representing the transfer properties of the cascaded filter.

From FIG. 5, it can be seen that the degradation of attenuation properties caused by inter-stage resonance has been improved due to the application of notch cavities (filters).

Figure 6:
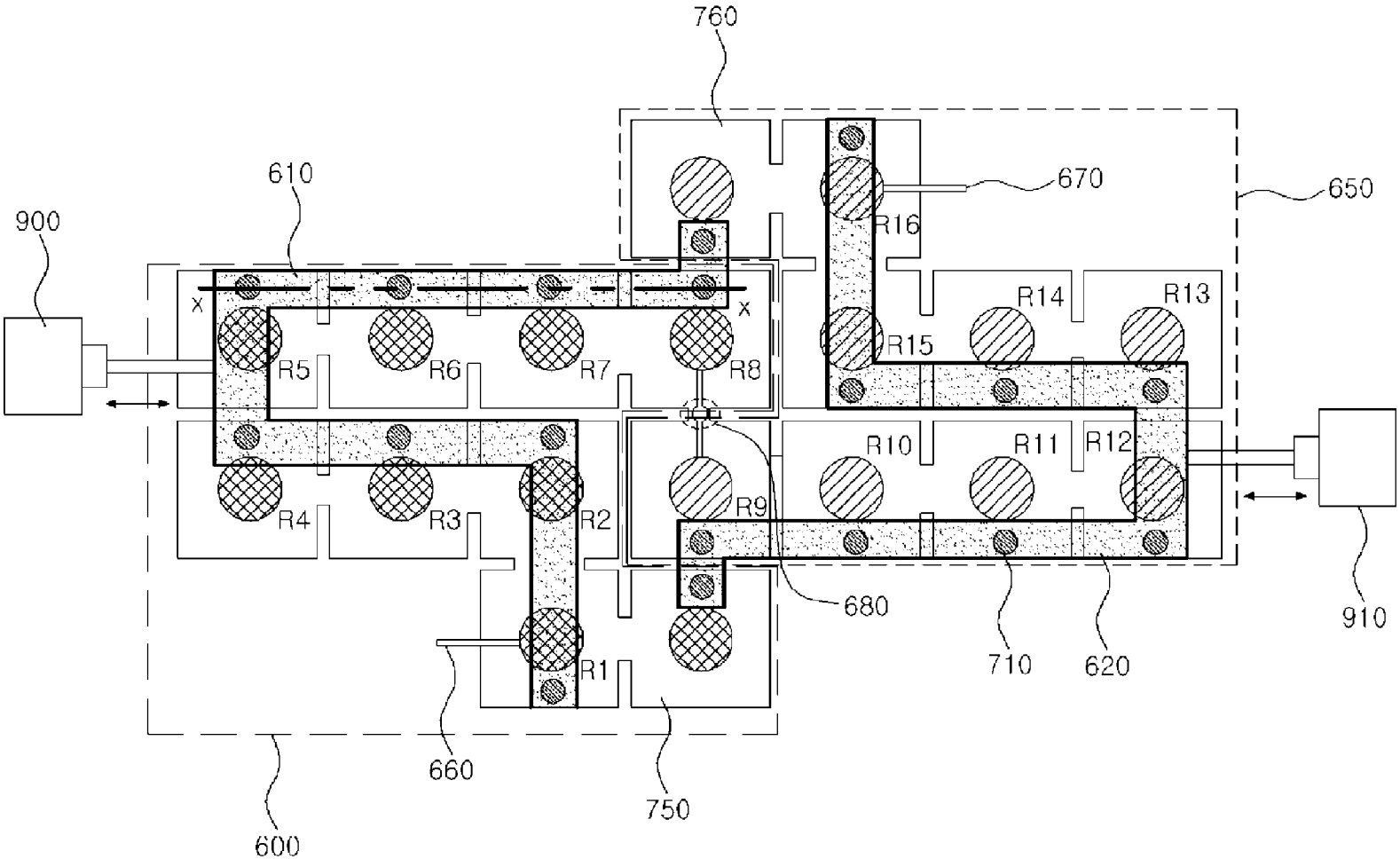
FIG. 6 is a diagram illustrating the structure of a bandwidth tunable filter according to an embodiment of the invention.

FIG. 6 is a diagram illustrating the structure of a bandwidth tunable filter according to an embodiment of the invention.

Referring to FIG. 6, a bandwidth tunable filter according to an embodiment of the invention may include a first frequency tunable filter unit 600 and a second frequency tunable filter unit 650. The first frequency tunable filter unit 600 and the second frequency tunable filter unit 650 may perform filtering independently, and after filtering is first performed at the first frequency tunable filter unit 600, the output signal of the first frequency tunable filter unit 600 may be provided to the second frequency tunable filter unit 650.

The first frequency tunable filter unit 600 may include eight resonators R1, R2, R3, R4, R5, R6, R7, R8, with each resonator held within a cavity. The second frequency tunable filter unit 650 may include eight resonators R9, R10, R11, R12, R13, R14, R15, R16.

The first frequency tunable filter unit 600 and the second frequency tunable filter unit 650 may be included in a single housing.

A first sliding member 610 for varying the center frequency may be placed over the resonators R1, R2, R3, R4, R5, R6, R7, R8 of the first frequency tunable filter unit 600. Also, a second sliding member 620 may be placed over the resonators R9, R10, R11, R12, R13, R14, R15, R16 of the second frequency tunable filter unit 650.

Figure 7:
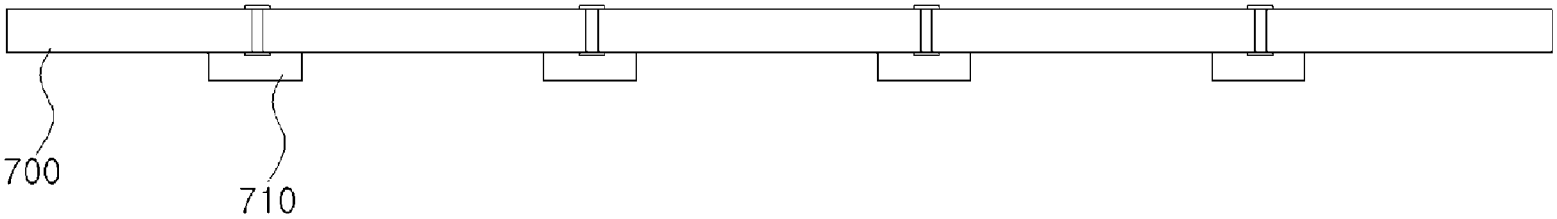
FIG. 7 is a cross-sectional view of a sliding member according to an embodiment of the invention.

FIG. 7 is a cross-sectional view of a sliding member according to an embodiment of the invention.

FIG. 7 shows a cross-sectional view across line x-x' of the sliding member 610.

Referring to FIG. 7, a sliding member according to an embodiment of the invention may include a main body 700 and a multiple number of tuning elements 710 joined to the main body. The number of tuning elements 710 may correspond to the number of resonators of each filter unit, and if there are eight resonators, as is the case in FIG. 6, then eight tuning elements may be joined to the main body 700.

The tuning elements 710 can be made of a metallic material or can be made of a dielectric material.

The main body 700 of a sliding member may be moved left and right by an actuator or by hand, and as the main body 700 is moved, the tuning elements 710 joined to the main body 700 may also be moved left and right.

FIG. 6 illustrates an example in which the first sliding member 610 and the second sliding member 620 are controlled independently by way of a first actuator 900 joined to the first sliding member 610 and a second actuator 910 joined to the second sliding member 620.

Figure 8:
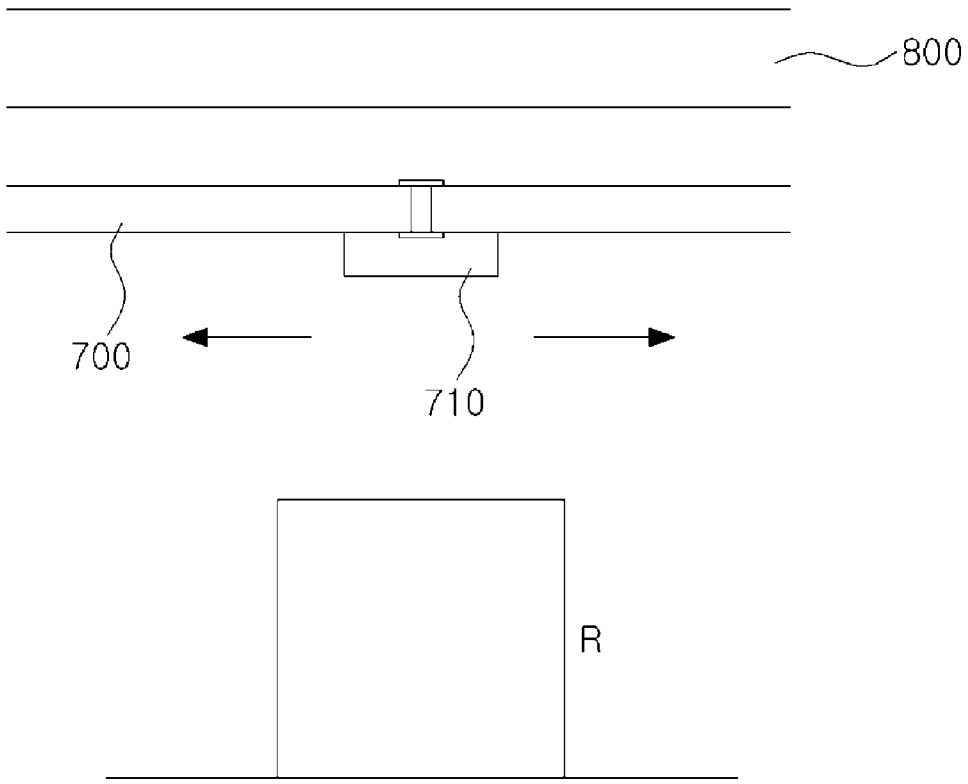
FIG. 8 is a cross-sectional view of a cavity in a bandwidth tunable filter according to an embodiment of the invention.

FIG. 8 is a cross-sectional view of a cavity in a bandwidth tunable filter according to an embodiment of the invention.

Referring to FIG. 8, a sliding member may be placed between the top of a resonator R and the cover 800 of the filter. Of course, the sliding member can also be placed over the cover, with the tuning element 710 inserted inside the filter through a hole in the cover or the like.

The tuning element 710 may move together according to the movement of the main body 700 of the sliding member.

The capacitance value determined by the cavity and the resonator R may be changed according to the movement of the tuning element 710, and the resonance frequency of the filter may be altered according to the change in the capacitance value.

The movement of the first sliding member 610 may cause a change in the center frequency of the first frequency tunable filter unit 600, while the movement of the second sliding member 620 may cause a change in the center frequency of the second frequency tunable filter unit 650.

Various structures have been developed for filters that use sliding members to enable alterations of the frequency, and it should be apparent to those of ordinary skill in the art that such known structures can be applied to an embodiment of the present invention.

At the cavity holding the first resonator R1 of the first frequency tunable filter unit 600, an input connector 660 may be joined. Input signals may be provided through the input connector 660 to the cavity holding the first resonator R1 of the first frequency tunable filter unit 600.

At the cavity holding the sixteenth resonator R16 of the second frequency tunable filter unit 650, an output connector 670 may be joined. A signal filtered by the first frequency tunable filter unit 600 and the second frequency tunable filter unit 650 may be outputted through the output connector 670.

Since the center frequency of the first frequency tunable filter unit 600 and the center frequency of the second frequency tunable filter unit 650 may be altered independently according to the respective movements of the first sliding member 610 and the second sliding member 620, it is possible to alter the bandwidth of the filter according to an embodiment of the invention.

The actuators 900, 910 for moving the first sliding member 610 and second sliding member 620 can be equipped in the interior of the housing or can be joined to the exterior of the housing.

Various structures can be applied for providing the output of the first frequency tunable filter unit 600 to the second frequency tunable filter unit 650.

As illustrated in FIG. 6, the last resonator R8 of the first frequency tunable filter unit 600 and the first resonator R9 of the second frequency tunable filter unit 650 can be connected with a transition line 680.

Through the transition line 680, the output signals of the first frequency tunable filter unit 600 may be provided to the second frequency tunable filter unit 650.

Of course, it is also possible to provide the output signals of the first frequency tunable filter unit 600 to the second frequency tunable filter unit 650 by a coupling method instead of using a transition line 680, unlike the case shown in FIG. 6. In order to provide the output signals of the first frequency tunable filter unit 600 to the second frequency tunable filter unit 650 by a coupling method, a coupling window for coupling may be formed between the cavity in which the last resonator of the first frequency tunable filter unit 600 is held and the cavity in which the first resonator of the second frequency tunable filter unit 650 is held.

As described above, a structure having two filters connected in a cascaded manner within a single housing can be subject to degraded properties at the stopbands due to inter-stage resonance.

According to a preferred embodiment of the invention, a transmission zero may be formed in the stopbands in order to improve the stopband properties, and two notch cavities may be formed in the first frequency tunable filter unit 600 and second frequency tunable filter unit 650 for the transmission zero.

A first notch cavity 750 may be formed in the first frequency tunable filter unit 600, and a second notch cavity 760 may be formed in the second frequency tunable filter unit 650.

The first notch cavity 750 may be formed next to the cavity holding the first resonator R1 of the first frequency tunable filter unit 600, while the second notch cavity may be formed next to the cavity holding the last resonator R16 of the second frequency tunable filter unit 650.

The first notch cavity 750 and second notch cavity 760 may be cavities for forming a transmission zero and may not participate in resonance. It is also possible to have resonators formed in the first notch cavity 750 and the second notch cavity 760.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

What is claimed is:

1. A bandwidth tunable filter comprising:

a first filter unit having a first band and having a structure capable of center frequency alteration; and a second filter unit having a second band and having a further structure capable of center frequency alteration, wherein the first filter unit and the second filter unit are joined in a cascaded structure wherein each of the first filter unit and the second filter unit comprises at least one cavity and a respective resonator held in each cavity, wherein the first filter unit and the second filter unit are included in a same housing, and an output signal of the first filter unit is provided as an input to the second filter unit, and wherein a last resonator of the first filter unit and a first resonator of the second filter unit are connected by way of a transition line.

2. The bandwidth tunable filter of claim 1, wherein the first filter unit structure capable of center frequency alteration and the second filter unit structure capable of center frequency alteration respectively include a first sliding member and a second sliding member, and alteration of the center frequency of the first filter unit and the second filter unit are performed independently.

3. The bandwidth tunable filter of claim 1, wherein an input connector is joined to a first resonator of the first filter unit, and an output connector is joined to a last resonator of the second filter unit.

4. The bandwidth tunable filter of claim 1, wherein a first notch cavity for forming a transmission zero is additionally formed next to at least one cavity from among the at least one cavity of the first filter unit.

5. The bandwidth tunable filter of claim 4, wherein a second notch cavity for forming a transmission zero is additionally formed next to at least one cavity from among the at least one cavity of the second filter unit.

6. A bandwidth tunable filter comprising:

a housing;

a first filter unit equipped within the housing, the first filter unit having a first band and having a structure capable of center frequency alteration; and a second filter unit equipped within the housing, the second filter unit having a second band and having a further structure capable of center frequency alteration, wherein an output signal of the first filter unit is provided as an input to the second filter unit wherein each of the first filter unit and the second filter unit comprises at least one cavity and a respective resonator held in each cavity, and wherein the first filter unit and the second filter unit are joined in a cascaded manner, and wherein a last resonator of the first filter unit and a first resonator of the second filter unit are connected by way of a transition line.

7. The bandwidth tunable filter of claim 6, wherein the first filter unit structure capable of center frequency alteration and the second filter unit structure capable of center frequency alteration respectively include a first sliding member and a second sliding member, and alteration of the center frequency of the first filter unit and the second filter unit are performed independently.

* * * * *